US005819998A

United States Patent [19]

Chehebar

[11] Patent Number: 5,819,998

[45] Date of Patent: Oct. 13, 1998

[54] KNAPSACK WITH SIMULATED BASKETBALL COURT

[75] Inventor: Joey Chehebar, Brooklyn, N.Y.

[73] Assignee: Everything Kids, New York, N.Y.

[21] Appl. No.: 724,612

[22] Filed: Sep. 30, 1996

[51] Int. Cl.[6] ..... A45F 4/02; A63F 7/20

[52] U.S. Cl. ..... 224/153; 224/576; 224/645; 224/653; 224/657; 224/584; 273/317.3; 273/DIG. 30; 206/315.1; D3/217

[58] Field of Search ..... 224/153, 576, 224/627, 645, 653, 584; 473/447, 450, 485, 487, 488, 489, 481, 482; 273/317.3, DIG. 17, DIG. 18, DIG. 19, 410, 348, 355, DIG. 30, 398, 407; 206/315.1, 579, 216; D3/216, 217; D21/5, 11, 200, 201; D9/337

[56] References Cited

U.S. PATENT DOCUMENTS

| | | | |
|---|---|---|---|
| D. 265,493 | 7/1982 | Kringlie | D21/201 |
| 2,939,707 | 7/1960 | Lemelson | 473/485 |
| 3,244,420 | 4/1966 | Poynter | D21/201 |
| 4,874,340 | 10/1989 | Smallwood | 224/153 |
| 5,104,124 | 4/1992 | Bernard et al. | 273/317.3 |
| 5,222,259 | 6/1993 | Bristor | 273/348 |
| 5,248,140 | 9/1993 | Matherne et al. | 206/315.1 |
| 5,255,833 | 10/1993 | McAllister | 224/602 |
| 5,407,112 | 4/1995 | Christodoulou et al. | 224/153 |
| 5,570,879 | 11/1996 | Glancey et al. | 273/DIG. 17 |
| 5,649,658 | 7/1997 | Hoffman et al. | 224/576 |

*Primary Examiner*—Linda J. Sholl
*Attorney, Agent, or Firm*—Steinberg & Raskin, P.C.

[57] ABSTRACT

A knapsack including a storage section and securing straps for securing the storage section to a wearer, such as a school-attending child. The storage section includes one or more storage compartments, e.g., for receiving school-related articles, a zipper for enabling access to the storage compartment(s), a hoop which can be extended outward from the storage section, a net suspended from the hoop and an attachable ball adapted to pass through the hoop and the net to enable simulation of basketball shooting.

15 Claims, 2 Drawing Sheets

KNAPSACK WITH SIMULATED BASKETBALL COURT

FIELD OF THE INVENTION

The present invention relates generally to a knapsack for carrying portable articles including an amusement and more particularly to a knapsack for children which includes a simulated basketball court and miniature basketball to enable a "basketball game" to be played or enable practice shooting a basketball.

BACKGROUND OF THE INVENTION

Children, as well as adults, who attend school often utilize knapsacks to carry their books, lunches, and other articles needed in connection with school. A typical knapsack has a storage section having one or more storage compartments for receiving the books, lunch boxes, etc., and a respective zipper for enabling access to the storage compartment(s), and two straps each of which connects to a top portion of the storage section and a bottom portion of the storage section such that the arms of the wearer can be passed through the space between the straps and the storage section so that the storage section is situated against the back of the child, i.e., the use position.

To satiate children's appetites for something different than their classmates, knapsacks come in a wide variety of shapes, sizes and designs. For example, popular knapsacks include action heroes, action movie related images, sports figures and sports team indicia. However, in spite of the depiction of such images on the knapsacks, knapsacks remained an unamusing object adapted solely for carrying portable articles.

OBJECTS AND SUMMARY OF THE INVENTION

Accordingly, it is an object of the present invention to provide a new knapsack which has an amusement associated therewith. More particularly, the knapsack has a miniature basketball hoop arranged in connection therewith and a "basketball" adapted to pass through the miniature basketball hoop which can be used together as entertainment and amusement to the wearer of the knapsack and others.

It is another object of the invention to provide a new knapsack which is interactive and can be used for an additional purpose other than to carry school-related articles.

In order to achieve these objects and others, the knapsack in accordance with the invention comprises a storage section and securing means for securing the storage section to the person, such as a school-attending child. The storage section includes at least one storage compartment receivable of articles, access means such as a zipper for enabling access to the storage compartment(s), a hoop which can be extended outward from the storage section, a net suspended from the hoop and an attachable ball adapted to pass through the hoop and the net to enable simulation of basketball shooting.

The securing means comprise a pair of straps each of which connects to a top portion of the storage section and a bottom portion of the storage section such that arms of the wearer are extendable through a respective space between the straps and the storage section so that the storage section is positionable against the back of the wearer. The straps each include adjustable tightening means for adjusting the size of the respective space between the strap and the storage section to enable children of different sizes to use the knapsack.

In one specific embodiment, the storage section comprises a first flat panel adapted to be situated against the back of the person and a second flat panel spaced from the first panel distanced from the back of the person such that a storage compartment is defined between the first and second panels and is selectively accessed by means of a zipper having one or two zipper tabs. A third flat panel is substantially transparent and is spaced from the second panel such that another storage compartment is defined between the second and third panels and is selectively accessed by means of a zipper having one or two zipper tabs.

The hoop is arranged in the storage compartment defined between the second and third panels such that it is visible through the transparent third panel. The visibility of the hoop provides discernable novelty to the knapsack to distinguish it from other, more conventional knapsacks. More particularly, the hoop is pivotally mounted to the second panel such that it is pivotable between a first, closed position in which it is adjacent the second panel (the "storage" position) and a second, open position in which it extends perpendicularly outward from the second panel (the "playing" position). To ensure that the ball is retained in connection with the knapsack when not in use, the ball and an interior part of the storage compartment defined between the second and third panels may include cooperating Velcro™ pieces.

To simulate a basketball court, the transparent third panel may include a design of basketball perimeter shooting lines in alignment with the hoop. In an alternative embodiment, the third panel is substantially opaque, instead of transparent, and comprises a design of basketball perimeter shooting lines in alignment with the hoop, possibly in the same color arrangement as a professional regulation basketball court.

BRIEF DESCRIPTION OF THE DRAWINGS

A more complete appreciation of the present invention and many of the attendant advantages thereof will be readily understood by reference to the following detailed description of the invention when considered in connection with the accompanying drawings in which.

DETAILED DESCRIPTION OF THE PREFERRED EMBODIMENTS

Figure 1:
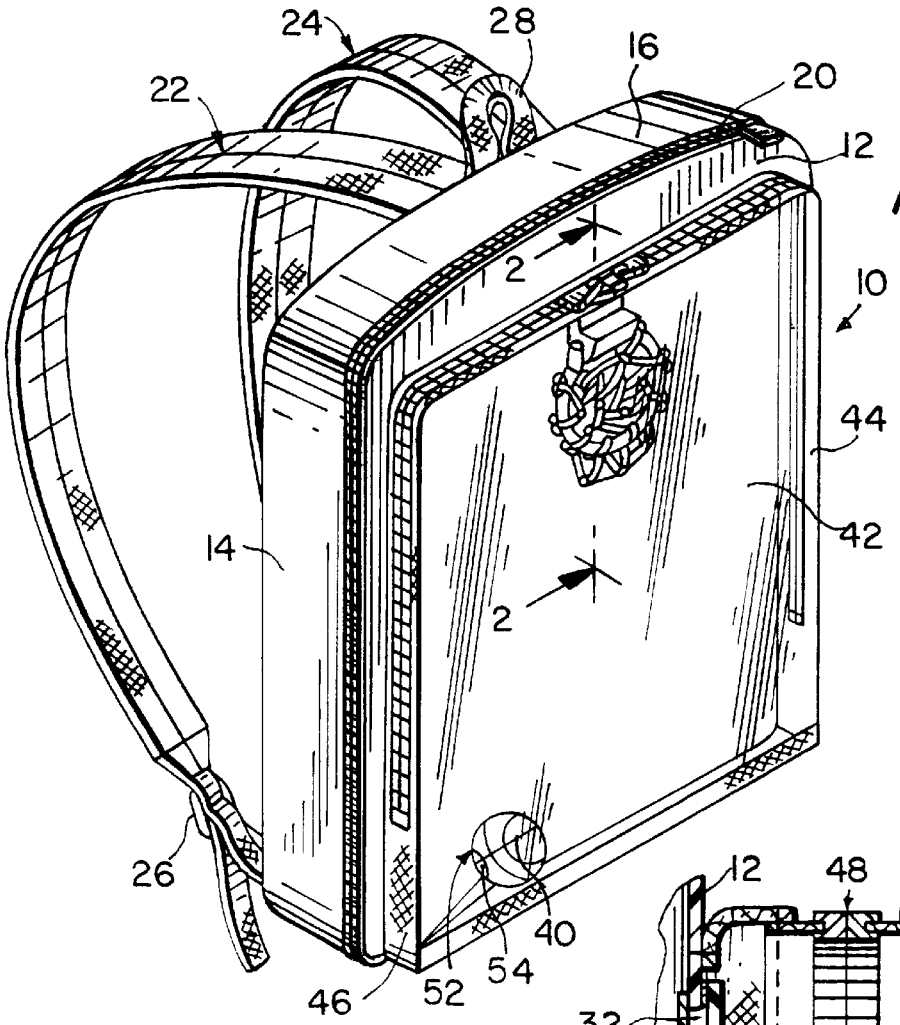
FIG. 1 is a perspective view of one embodiment of the knapsack in accordance with the invention wherein the basketball hoop is visible through a transparent outer panel.
Figure 4:
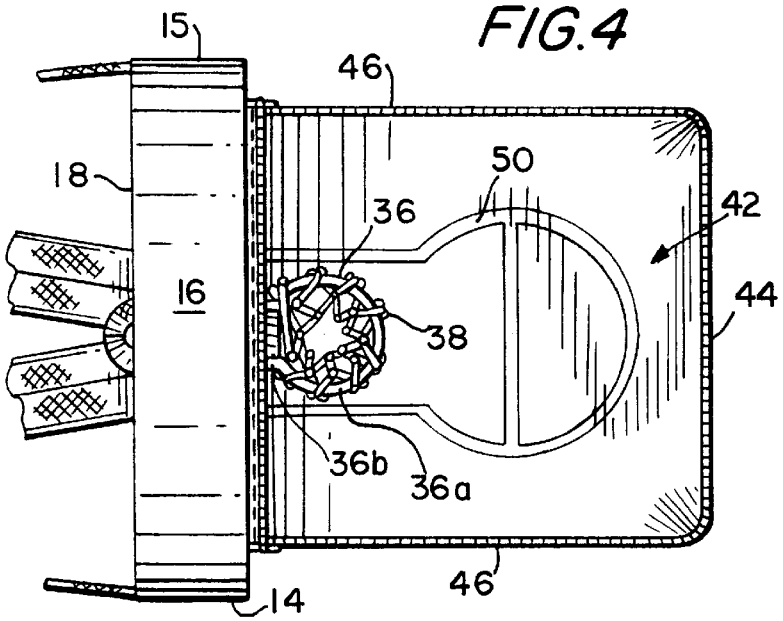
FIG. 4 is a top view of the knapsack in which the compartment in which the basketball hoop is arranged is in an open position to enable the simulation of basketball shooting and the flap is substantially opaque and includes a design of basketball perimeter shooting lines.

Referring to the accompanying drawings wherein like reference characters designate identical or corresponding parts throughout the several views, a knapsack in accordance with the invention is generally designated as 10 and is shown in a closed position in FIG. 1. The knapsack 10 enables hands-free carrying of books, lunch boxes and other school-related articles and is constructed of a front panel 12, side panels 14,15, a top panel 16, a bottom panel 17 and a rear panel 18 interconnected to one another or manufactured in connection with one another, e.g., by sewing. The front and rear panels 12,18 are substantially flat and have a substantially rectangular shape to provide the knapsack with a generally rectangular appearance. The front panel 12 is attached along peripheral edges thereof to opposed side panels 14,15 and top panel 16 by means of a zipper 20 having at least one zipper tab interacting with two intermeshing tracks, one on the peripheral edges of the front panel 12 and the other extending along the side panels 14,15 and top panel 16 (not shown). The side panels 14,15 and top panel 16 can be designed to completely overlie the zipper 20 to obscure the same (FIG. 4).

A pair of adjustable straps 22,24 are attached at ends thereof, e.g., by sewing, to a top portion of the rear panel 18 and a bottom portion of the rear panel 18. Each strap 22,24 includes adjustment means such as an adjustment buckle 26 which enables the respective space defined between the strap 22,24 and the rear panel 18 to be varied to fit the wearer of the knapsack.

Figure 3:
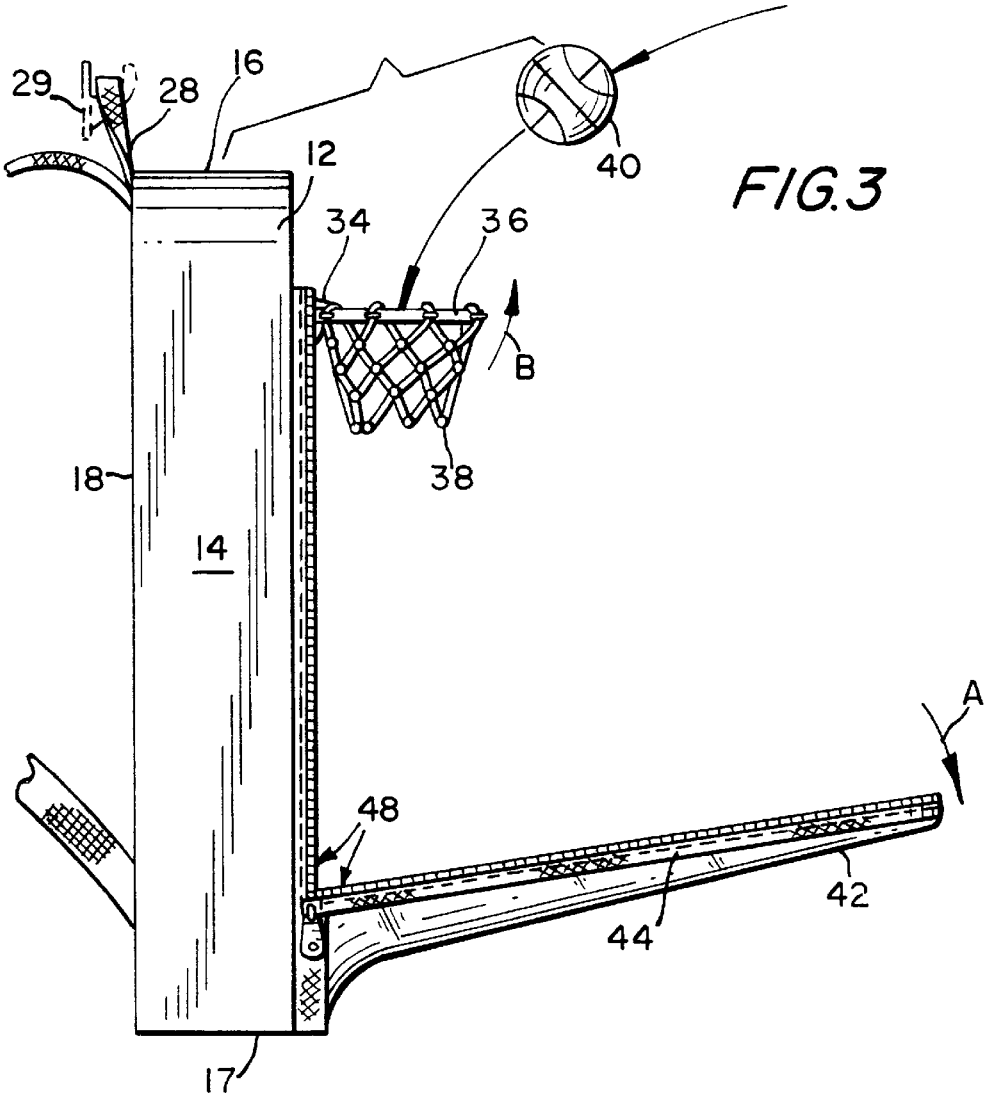
FIG. 3 is a side view of the knapsack in which the compartment in which the basketball hoop is arranged is in an open position to enable the simulation of basketball shooting.

A material loop 28 is attached, e.g., by sewing, at opposed ends thereof to the rear panel 18 of the knapsack 10 for hanging or holding the knapsack 10 to a stationary structure, e.g., to a hook 29 (FIG. 3). The loop 28 for mounting the knapsack 10 will be useful during use of the "basketball game" in accordance with the invention (as described below).

Although the above-described type and arrangement of panels 12,14,15,16,17,18, zipper 20, straps 22,24, buckles 26 and loop 28 are present in the illustrated embodiment and almost standard in the manufacture of knapsacks, other conventional substitute constructions of knapsacks will adequately suffice and are within the scope and spirit of the invention.

In accordance with the invention, a hoop mounting bracket 30 is arranged on the front panel 12 and comprises pegs 32 which extend through the front panel 12 to securely fix the hoop mounting bracket 30 to the front panel 12. The hoop mounting bracket 30 includes a recess 34 in an interior thereof. A substantially circular hoop 36 having a circular cross-section passes through the recess 34. Preferably, the hoop 36 has a first portion 36*a* which forms substantially the entire periphery of a circle and a second extension portion 36*b* which extends beyond the circle and is passed through the recess 34 so that upon extension of the hoop, a complete circular aperture is provided for passage of a complementary ball and the hoop mounting bracket 30 does not interfere therewith. A net 38 of interwoven material strips is suspended from the hoop 36.

Figure 2:
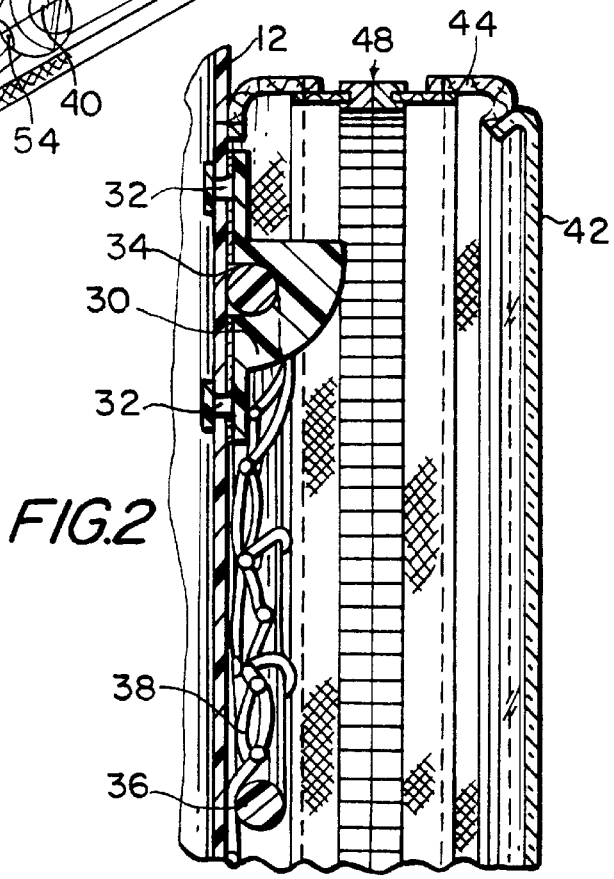
FIG. 2 is a sectional view taken along the line 2—2 of FIG. 1.

The hoop 36 is movable within the recess 34 between a first, closed position shown in FIGS. 1 and 2 in which the hoop 36 is situated alongside the front panel 12 and a second, open position shown in FIGS. 3 and 4 in which the hoop 36 extends perpendicularly outward from the front panel 12. However, the recess 34 and hoop 36 are dimensioned so that the recess 34 provides some resistance to the movement of the hoop 36, i.e., the hoop 36 is not easily and freely movable within the recess 34, in order to enable the hoop 36 to be maintained in the open position and prevent movement of the hoop 36 from its second, open position to the first, closed position whenever a ball 40 contacts an upper surface of the hoop 36.

Another substantially flat, rectangular panel 42 is attached to the front panel 12 or flap extensions thereof by means of an interconnected top panel 44 and interconnected side panels 46 attached to the panel 42. A zipper 48 is provided and has at least one zipper tab interacting with two intermeshing tracks, one extending along peripheral edges of the top and side panels 44,46 attached to the panel 42 and the other extending along opposed portions of the panel 12, to thereby form an accessible compartment between the front panel 12 and the panel 42 for storing articles. The hoop 36 is situated within this compartment when the compartment is closed. The ball 40 is also stored in the compartment and suitable cooperating attachment means can be fixed to the ball 40, e.g., Velcro™ strip 54, and an interior surface of the compartment, e.g., Velcro™ strip 52.

When the compartment is open, i.e., the top and side panels 44,46 attached to the panel 42 are separated from the front panel 12 by unzipping the zipper 48 and the panel 42 is lowered in the direction of arrow A as shown in FIG. 3, the hoop 36 is exposed and can be moved from the closed position shown in FIG. 2 in the direction of arrow B to the open, playing position shown in FIG. 3. It is then possible to "shoot" the ball 40 into the hoop 36, simulating basketball shots (FIG. 3). To provide simulation of a basketball game, basketball perimeter shooting lines 50 are arranged on the interior surface of the panel 42 (FIG. 4).

Instead of the transparent panel 12, the panel 42 may be opaque and colored, e.g., to appear wood-grained as on NBA-regulation basketball courts (FIG. 4).

For use, the knapsack 10 is ideally hooked onto a stationarily mounted hook 29 by means of the engagement of the hoop 28 with the stationarily mounted hook 29 (FIG. 3), the zipper 48 is opened completely so that the panel 42 is lowered away from opposed panel 12 (FIG. 3), the hoop 36 is raised from its closed position (FIGS. 1 and 2) to its open position (FIGS. 3 and 4), and the ball 40 is detached from its storage position within the compartment defined between the panel 12 and the panel 42. The ball 40 can then be propelled into the hoop 36 in a fairly accurate simulation of basketball shooting to thus provide an amusement in conjunction with a knapsack.

The examples provided above are not meant to be exclusive. Many other variations of the present invention would be obvious to those skilled in the art, and are contemplated to be within the scope of the appended claims.

I claim:

1. A knapsack for carrying portable articles supportable on a back of a wearer, comprising a storage section having at least one storage compartment for receiving the articles and access means for enabling access to said at least one storage compartment, said storage section including a first, substantially flat panel defining at least a part of said at least one compartment, securing means for securing said storage section to the wearer, a hoop having a net suspended therefrom, said hoop being pivotally mounted to said first panel such that said hoop pivots between a first, closed position in which said hoop is adjacent said first panel and a second, open position in which said hoop extends perpendicularly outward from said first panel, and a removable ball arranged to pass through said hoop and said net.

2. The knapsack of claim 1, wherein said securing means comprise a pair of straps each of which connects to a top portion of said storage section and a bottom portion of said storage section such that arms of the wearer extend through a respective space between said strap and said storage section so that said storage section is situatable tightly against the back of the wearer.

3. The knapsack of claim 2, wherein said securing means further comprise adjustable tightening means connected to each of said straps for adjusting the size of the respective space between said strap and said storage section.

4. The knapsack of claim 1, wherein said storage section comprises a second substantially flat panel spaced from said first panel, said second panel being substantially transparent and defining in part said at least one compartment, said hoop being arranged in said at least one compartment such that said hoop is visible through said second panel.

5. The knapsack of claim 4, wherein said at least one compartment comprises first and second compartments, further comprising a third substantially flat panel adapted to be situated against the back of the wearer such that said first compartment is defined between said first and third panels and said second compartment is defined between said first and second panels, and means for pivotally mounting said hoop in said second compartment to said first panel.

6. The knapsack of claim 5, wherein said access means comprise a first zipper engaging with said first and third panels and a second zipper engaging with said first and second panels.

7. The knapsack of claim 4, wherein said second panel comprises a design of basketball shooting lines in alignment with said hoop.

8. The knapsack of claim 1, wherein said storage section comprises a second substantially flat panel spaced from said first panel, said second panel being substantially opaque, defining in part said at least one compartment and comprising a design of basketball shooting lines in alignment with said hoop, said hoop being arranged in said at least one compartment.

9. The knapsack of claim 8, wherein said at least one compartment comprises first and second compartments, further comprising a third substantially flat panel adapted to be situated against the back of the wearer such that said first compartment is defined between said first and third panels and said second compartment is defined between said first and second panels, and means for pivotally mounting said hoop in said second compartment to said first panel.

10. The knapsack of claim 9, wherein said access means comprise a first zipper engaging with said first and third panels and a second zipper engaging with said first and second panels.

11. The knapsack of claim 1, further comprising means for hanging said knapsack to a hook, said means comprising a material loop attached to said storage section.

12. A knapsack for carrying portable articles supportable on a back of a wearer, comprising a storage section having first and second compartments for receiving the articles and access means for enabling access to said first and second compartments, said storage section comprising a first substantially flat panel adapted to be situated against the back of the wearer, a second substantially flat, transparent panel spaced from the first panel, and a third panel arranged between said first and second panel such that said first compartment is defined between said first and third panels and said second compartment is defined between said second and third panels, securing means for securing said storage section to the wearer, a circular hoop arranged on said third panel, a net suspended from said hoop, a removable ball arranged to pass through said hoop and said net, and means for pivotally mounting said hoop to said third panel and in said second compartment, said hoop being arranged to pivot between a first, closed position in which said hoop is adjacent said third panel and a second, open position in which said hoop extends perpendicularly outward from said third panel and from the wearer.

13. The knapsack of claim 12, wherein said access means comprise a first zipper engaging with said first and third panels and a second zipper engaging with said second and third panels.

14. A knapsack for carrying portable articles supportable on a back of a wearer, comprising a storage section having first and second compartments for receiving the articles and access means for enabling access to said first and second compartments, said storage section comprising a first substantially flat panel adapted to be situated against the back of the wearer, a second substantially flat panel spaced from said first panel, a third panel arranged between said first and second panel such that said first compartment is defined between said first and third panels and said second compartment is defined between said second and third panels, securing means for securing said storage section to the wearer, a hoop extendable outward from the wearer, said second panel being substantially opaque and comprising a design of basketball shooting lines in alignment with said hoop, a net suspended from said hoop, and a removable ball arranged to pass through said hoop and said net, and means for pivotally mounting said hoop to said third panel and in said second compartment, said hoop being arranged to pivot between a first, closed position in which said hoop is adjacent said third panel and a second, open position in which said hoop extends perpendicularly outward from said third panel.

15. The knapsack of claim 14, wherein said access means comprises a first zipper engaging with said first and third panels and a second zipper engaging with said second and third panels.

* * * * *